US005146133A

United States Patent [19]

Shirai et al.

[11] Patent Number: 5,146,133

[45] Date of Patent: Sep. 8, 1992

[54] ELECTRON GUN FOR COLOR CATHODE RAY TUBE

[75] Inventors: Shoji Shirai; Satoru Miyamoto, both of Mobara; Kazunari Noguchi, Chiba; Masahiro Miyazaki, Mobara, all of Japan

[73] Assignee: Hitachi, Ltd., Tokyo, Japan

[21] Appl. No.: 545,719

[22] Filed: Jun. 29, 1990

[30] Foreign Application Priority Data

Jul. 4, 1989 [JP] Japan ..... 64-171202
Jul. 14, 1989 [JP] Japan ..... 64-180310

[51] Int. Cl.[5] ..... H01J 29/56

[52] U.S. Cl. ..... 313/414; 313/412; 313/432; 313/439

[58] Field of Search ..... 313/414, 412, 413, 432, 313/439

[56] References Cited

U.S. PATENT DOCUMENTS 4,599,534 7/1986 Shirai et al. ..... 313/414
4,766,344 8/1988 Say ..... 313/414
4,833,364 5/1989 Izumida et al. ..... 313/414

FOREIGN PATENT DOCUMENTS 0215640 12/1984 Japan .
0076241 4/1988 Japan .
0086224 4/1988 Japan .
0096843 4/1988 Japan .

*Primary Examiner*—Palmer C. DeMeo
*Assistant Examiner*—Ashok Pael
*Attorney, Agent, or Firm*—Antonelli, Terry, Stout & Kraus

[57] ABSTRACT

An electron gun for a color cathode ray tube having a structure that a plate electrode to be provided within the focusing electrode is given the structure adding the external portion and providing in parallel three elliptical apertures in place of providing the cutout portion at the external portion, a plate electrode to be provided within the acceleration electrode is given the structure providing the cutout portion at the external portion and the vertical axis including the center of external elliptical portion is arranged outside the center axis when the side electron beam enters the main lens is capable of correcting astigmatism and satisfying static convergence. Moreover, rotation and deformation of plate electrode during assembling of electrode can be prevented by providing the straight line portion to the side beam apertures, aberration of lens to be generated at the main lens portion can be reduced and focus characteristic can also be stablized.

5 Claims, 7 Drawing Sheets

ELECTRON GUN FOR COLOR CATHODE RAY TUBE

BACKGROUND OF THE INVENTION

The present invention relates to an electron gun for color cathode ray tube, particularly to an electrode structure forming a main lens of in-line type electron gun and more specifically to an electron gun for color cathode ray tube which reduces generation of astigmatism, has good static convergence characteristic and also provides a structure easily ensuring highly accurate assembling.

An outline of structure of a color cathode ray tube will be explained with reference to the accompanying drawings.

FIG. 1 is a structural diagram of a color cathode ray tube of the prior art.

In this figure, a phosphor surface 3 formed by alternate coating of striped three-color phosphor materials is supported at the internal wall of face plate 2 of an external glass enclosure 1. The center axes 15, 16, 17 of the cathodes 6, 7, 8 respectively match the center axes of the apertures corresponding to a first grid electrode (G1) 9, a second grid electrode (G2) 10, a third grid electrode (G3) forming a main lens and the cathode of a shield cup electrode 13 and these are also arranged almost in parallel with each other on the common plane. The center axis 16 also matches with the center axis of the electron gun as a whole.

The center axis of the aperture at the center of a fourth grid electrode (G4) 12, which is the other electrode forming the main lens, matches with the center axis 16 but the center axes 18, 19 of both side apertures do not match with the corresponding center axes 15, 17 and are deviated a little outwardly.

Three electron beams emitted from respective cathodes enter the main lens along the center axes 15, 16, 17. The G3 electrode 11 is set to a voltage lower than that of G4 electrode 12, while the high voltage G4 electrode 12 is set to the voltage equal to that of the shield cup 13 and a conductive film 5 provided within the glass enclosure. Since the apertures at the center of both G3 electrode 11 and G4 electrode 12 are provided coaxially, the main lens formed at the center of both electrodes becomes symmetrically about the axis and thereby the center beam is once focused by the main lens and then runs straight on the orbit along the axis. Meanwhile, the side apertures of both electrodes are deviated axially with each other and therefore a field element is formed asymmetrically about the axis in the outside of axis. Therefore, the side beam is deflected toward the center beam by the axially asymmetrical field element and receives a concentrated force toward the center beam simultaneously with the focusing effect by the main lens. Thereby three electron beams are focused on the shadow mask 4 and are overlappingly concentrated.

The operation to concentrate the beams is called the static convergence (hereinafter referred to as STC).

Moreover, each electron beam is color-selected by the shadow mask 4 and only the element which excites the phosphor material of the color corresponding to each beam passes through the apertures of shadow mask 4 and reaches the phosphor surface. Moreover, an external magnetic deflection yoke 14 is provided to scan the phosphor surface with the electron beam.

It is generally known that spherical aberration of the main lens is a factor which gives large influence on the resolution characteristic of a color cathode ray tube. It is also known that enlargement of diameter of the electrodes forming the main lens is particularly effective to reduce the spherical aberration of the main lens.

However, in the case of an in-line type electron gun as shown in FIG. 1, the cylindrical main lenses respectively corresponding to R, G, B colors are arranged on the same plane. Therefore, the diameter of aperture must be less than $\frac{2}{3}$ of the internal diameter of neck portion accommodating the electron guns among the glass enclosure 1. The limit value of such internal diameter is further reduced, considering thickness of electrodes and problem on manufacture of electrodes.

When the internal diameter of neck portion is enlarged in view of increasing the limit value, a deflection voltage also increases. Moreover, when the aperture diameter is increased, deviation from the center of aperture and distance between center axes of beams also increase, resulting in a problem that the convergence characteristic is deteriorated. Since the aperture diameter is generally set as large as possible considering such problems, further enlargement thereof is extremely difficult.

An example of non-cylindrical main lens is described in the Japanese Laid-open Patent No. 59-215640, wherein the aperture diameter of electron guns can substantially be enlarged more than the limit value explained above.

FIG. 2 is a diagram for explaining the structure of main lens of electron gun by the prior art. The reference numeral 11 denotes a G3 electrode; 12, a G4 electrode; 101, 102, cylindrical electrodes of each electrode; 121, 122, plate electrodes of each electrode.

In the same figure, the plate electrodes 121, 122 provided at the surfaces of G3 electrode 11 and G4 electrode 12 opposed with each other are arranged backward from the opposed surface and thereby the electric field of opposed electrodes enters deeply into the plate electrodes, realizing the same effect as the aperture diameter is enlarged. However, since the horizontal diameter of the sectional view of circumferential portion of electrode is larger than the vertical diameter, the field enters remarkably in the horizontal direction. Thereby, a lens converging force of horizontal direction becomes weaker than that of the vertical direction, generating astigmatism in the electron beam. In order to correct astigmatism, the aperture is formed in the non-circular form and the aperture diameter in the horizontal direction is set smaller than that of vertical direction. Thereby, a convergent field in the horizontal sectional view can be enhanced and the converging forces in both horizontal and vertical directions are balanced to eliminate astigmatism.

The main lens portion can be assembled as follow. Namely, as shown in FIG. 3, the G4 electrode 12, G3 electrode 11, G2 electrode 10 and G1 electrode 9 are inserted into core bar jigs 21 passing through the electrode apertures, the spacers (not illustrated) are provided between the electrodes for the positioning and multiform glass 20 which is softened by heat processing is attached and welded to the fitting portions of electrodes 9~12.

For easy assembling of the electron gun in such a structure as shown in FIG. 2, it is required that the side portion of the aperture of the opposed regions of the G3 electrode 11 and G4 electrode 12 is formed in such a shape that the semi-circular area or a part of semi-circular area of the center axes 15, 17 of the external side beam orbit shown in FIG. 1 is extracted. The first reason is that parts of electrodes can be manufactured more easily and accuracy can also be attained more easily in comparison with the electrodes of elliptical shape. The second reason is that the core bar jig 21 shown in FIG. 3 to be used for alignment of the apertures of electrodes in the electron gun along the center axes 15, 16, 17 can be manufactured easily with higher accuracy. Namely, the sectional view of the portion of the core bar jig 21 passing through the opposed apertures of the G3 electrode 11 and G4 electrode 12 can be formed in the semi-circular shape or the shape in which the semi-circular shape is partly cut out, and moreover can be formed coaxially with the part passing through the apertures of the G1 electrode 9, G2 electrode 10 and G3 electrode 11. Thereby, partial axial deviation and the shape such as elliptical section which are difficult to be manufactured does not exist.

For instance, the G4 electrode 12 of this structure is shown in FIG. 4. Namely, when the points corresponding to the center axes of cathodes 15, 16, 17 are assumed as O, P, Q, a short side in the horizontal direction of cylindrical electrode 102 is formed at the portions between the arcuated portions 102*a* of the radius $R_1$ about the points O, Q and a long side in the vertical direction thereof is formed at the straight line portion 102*b* separated by V from the straight line X connecting the points O and Q. Here, $V=R_1$ Therefore, an intersecting point D of the straight line 102*b* an arcuate portion 102*a* exists on the vertical lines 115, 117 which is perpendicular to the straight line X and passes through the points O, Q.

On the other hand, the plate electrode 122 is provided with an aperture for the center beam, except for the part of both ends in the horizontal direction in contact with the cylindrical electrode 102, and the side beam apertures in both sides are surrounded by the end portion 122*a* of plate electrode 122 and the cylindrical electrode 102. The end portion 122*a* is generally formed in the elliptical shape on the plane and crosses with the point D.

Although a figure and explanation are omitted here, the G3 electrode 11 and the G4 electrode 12 have almost the same structure.

Moreover, it is desirable that the G3 electrode 11 and G4 electrode 12 have the same aperture shape of the opposed areas from the following two reasons. The first reason is that the manufacturing process of electrode parts must be simplified and the second reason is that when a constant manufacturing error is generated during manufacture of parts, the effects applied on the electron beam work in the reverse directions on the G3 electrode 11 and G4 electrode 12 respectively and thereby such effects are cancelled with each other and influence of dimensional error can be reduced.

SUMMARY OF THE INVENTION

The conventional structure brings about a problem that if the side areas of apertures in the opposed region of the G3 electrode 11 and G4 electrode 12 are formed in the semi-circular shape where the centers are located on the center axes 15, 17, it is difficult to simultaneously satisfy elimination of astigmatism and STC, because when generation of astigmatism is suppressed by taking balance between the lens strength of main lens in the external side and internal side thereof since the outer half of main lens for focusing a side beam is formed symmetrically about the axis, the total lens strength becomes almost equal in the periphery of the center axes 15, 17.

As explained above, since the non-axis symmetrical field lens is not generated on the main lens, the side beam cannot be deflected and it is difficult to obtain STC.

Moreover, in the structure of G3 electrode 11 and G4 electrode 12 shown in the prior art, when the G3 electrode 11 and G4 electrode 12 generates rotation in the horizontal direction, axial deviation is generated for the beam passing center axes 15, 16, 17, thereby the main lens is distorted and lens aberration increases, deteriorating the focus characteristic. In order to minimize such events, the core bar jig 21 is formed, as shown in FIG. 5, to match the arcuate portions 101*a*, 102*a* of cylindrical electrodes 101 and 102 of the G3 electrode 11 and G4 electrode 12.

As explained above, the structure of the conventional G3 electrode 11 and G4 electrode 12 has the following problem because it is required to prevent rotation of the G3 electrode 11 and G4 electrode 12 by matching the core bar jig 21 with the arcuate portions 101*a* and 102*a* of the cylindrical electrodes 101 and 102.

Here, only the G4 electrode 12 is considered. As shown in FIG. 6, in case the plate electrode 122 is fixed to the cylindrical electrode 102 with axial deviation $\delta$ for the center line X of the cylindrical electrode 102, the end portion G of the plate electrode 122 is protruded by $\delta$ from the point D. When such G4 electrode 12 is pushed into the core bar jig 21, the protruded portion G of plate electrode 122 is in contact with the core bar jig 21 and deforms, thereby the main lens is locally distorted, also deteriorating focus characteristic.

Such deformation of electrodes is detected after completing assembly of electrodes and it is difficult to check such deformation and such deformation has brought about remarkable cost up in mass production line. In addition, deviation between the cylindrical electrode and plate electrode may be checked in the stage of parts, but the electrodes must be put at the right angle for the core bar jig and if the angle is deviated even a little, the end portion of plate electrode is in contact with the core bar jig and it has also been difficult to perfectly eliminate the potential of deformation.

It is therefore an object of the present invention to provide an electron gun for color cathode ray tube providing the electrode shape which has simplified assembling and manufacture of electrode parts and satisfied STC by forming the semi-circular aperture of the opposed area of electrode forming the main lens where the center i located on the center axes 15, 17.

It is another object of the present invention to provide an electron gun for color cathode ray tube which can prevent deformation of the plate electrode during assembling thereof and realizes stabilized focus characteristics.

In view of attaining such objects, the present invention is characterized in that the external shape of the plate electrode 121 or 122 is defined as follow so that the outer half of main lens for focusing the side beam among three beams becomes non-symmetrical. In other words, the external portion of the plate electrode 121 in the side of focusing electrode is not given the cutout structure, unlike the prior art shown in FIG. 2, but the structure where three elliptical apertures are provided in parallel The external portion of plate electrode 122 in the side of acceleration electrode is given the cutout structure and moreover the perpendicular axis including the center of the external ellipse is arranged in the outside of the center axes 15, 17.

It is generally known that a part within the focusing electrode 11 of main lens forms a focusing lens and a part within the acceleration electrode 12 forms a divergence lens. The present invention adds the external portion to the plate electrode 121 of the focusing electrode, eliminating the output portion, and thereby substantially shifts the center axis of focusing lens toward the center beam. Accordingly, the side beam enters the external side of the center axis of focusing lens and is deflected toward the center beam with the effect of focusing lens, attaining STC.

Meanwhile, the external portion of plate electrode 122 in the side of acceleration electrode is given the cutout structure. Therefore, the external side end portion is given the shape where the one of ellipse shape divided into two portions at the center axis in the vertical direction is taken out. In the present invention, the center axis of divergence lens formed to the acceleration electrode is substantially shifted to the outside by arranging the center axis of the ellipse to the outside of the center axes 15, 17 when the side electron beam enters the main lens. Therefore, the electron beam passes through the internal side of the center axis of the divergence lens and thereby it is deflected toward the center electron beam.

As explained above, the electron beam is deflected toward the center electron beam in both electrodes of the focusing electrode 11 and acceleration electrode 12.

In view of attaining another object of the present invention, in the electrode to form the main lens formed surrounding the side beam apertures in both sides with the end portion of plate electrode and cylindrical electrode consisting of the elliptical cylindrical electrode having longer axes of the arranging lines of three electron beams and the plate electrode which is fixed within the cylindrical electrode and is provided only with the aperture through which the center beam passes, the end portion of plate electrode is caused to cross the straight line portion of the cylindrical electrode, this crossing point is formed at the inside for the longer axis from the crossing point of the straight line of cylindrical electrode and semi-circular portion of cylindrical electrode, and the straight line portion is provided to the side beam apertures.

Since the both side beam apertures have the straight line portion, the rotation of electrodes for the core bar jig can be prevented by receiving the straight line portion with the core bar jig. Moreover, the core bar jig may be formed in such a manner that the cross point of the end portion of plate electrode and the straight line portion of cylindrical electrode does not contact with the core bar jig and thereby deformation of plate electrode when the electrodes are inserted into the core bar jig can be prevented.

DESCRIPTION OF THE PREFERRED EMBODIMENTS

Figure 1:
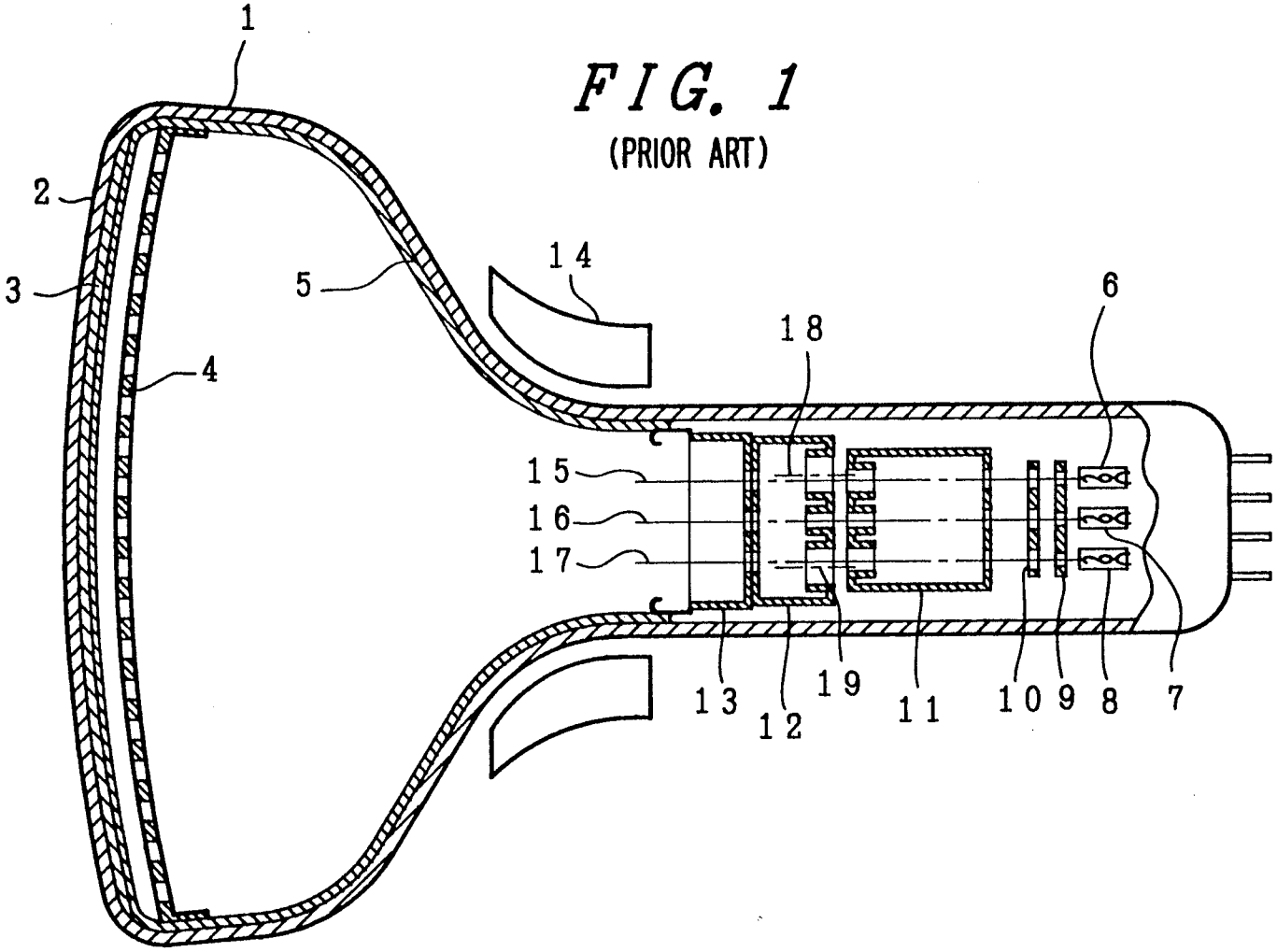
FIG. 1 (PRIOR ART)
FIG. 1 is a diagram indicating a structure of a color cathode ray tube of the prior art.
Figure 3:
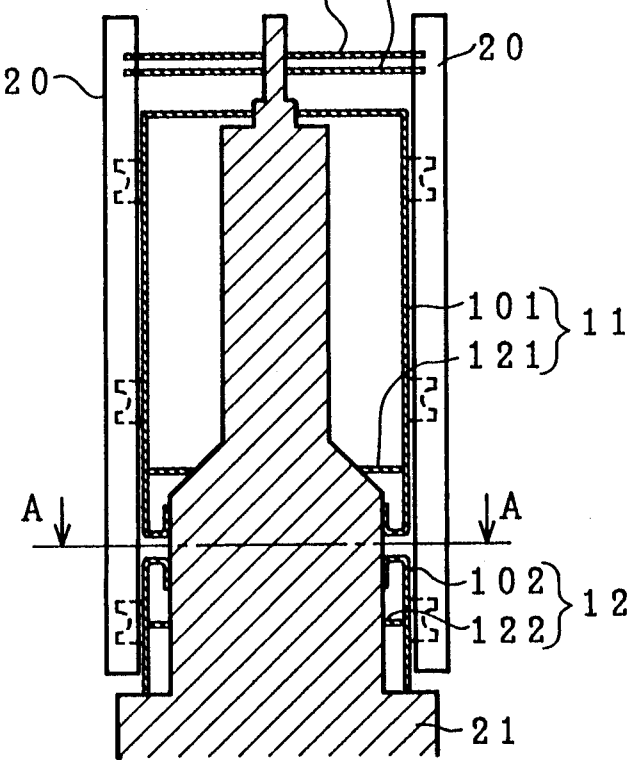
FIG. 3 (PRIOR ART)
FIG. 3 is a sectional view in the vertical direction of electron gun of FIG. 1 during assembling of the major electrode portions.

An embodiment of the present invention will be explained with reference to the accompanying drawings.

FIG. 7(*a*) to 7(*d*) are diagrams for explaining the main lens electrode indicating an embodiment of an electron gun for color cathode ray tube of the present invention. In these Figures, (a) is a sectional view of vertical direction of main lens; (b) is a sectional view along the line B—B of (a); (c) is a plan view of plate electrode of focusing electrode; (d) is a plan view of the plate electrode of acceleration electrode.

In FIG. 7(*a*), the reference numeral 11 denotes a focusing electrode; 12, an acceleration electrode; 111, a plate electrode provided within the focusing electrode at the backward area of the opposed surface of focusing electrode 11 and acceleration electrode 12; 112, a plate electrode provided within the acceleration electrode in the backward of the opposed surface; d3, d4, distance of plate electrodes 111, 112 shifted backward.

In FIG. 7(*b*), R is radius of semi-circular end portions of aperture of the focusing electrode 11; V is vertical radius of both end portions of aperture; and H is horizontal radius of both end portions of aperture.

In FIG. 7(*c*), the reference numerals 115, 116, 117 denote vertical axes crossing the center axis of the electron beam; S, interval of electron beams; a3 is radius of elliptical aperture at the center; b3, internal radius of side elliptical aperture; c3, external radius of side elliptical aperture.

In FIG. 7(*d*), 113, 114 denote vertical axes including the center of side ellipse of plate electrode 112; a4, radius of center elliptical aperture and b4, radius of side elliptical aperture.

Figure 2:
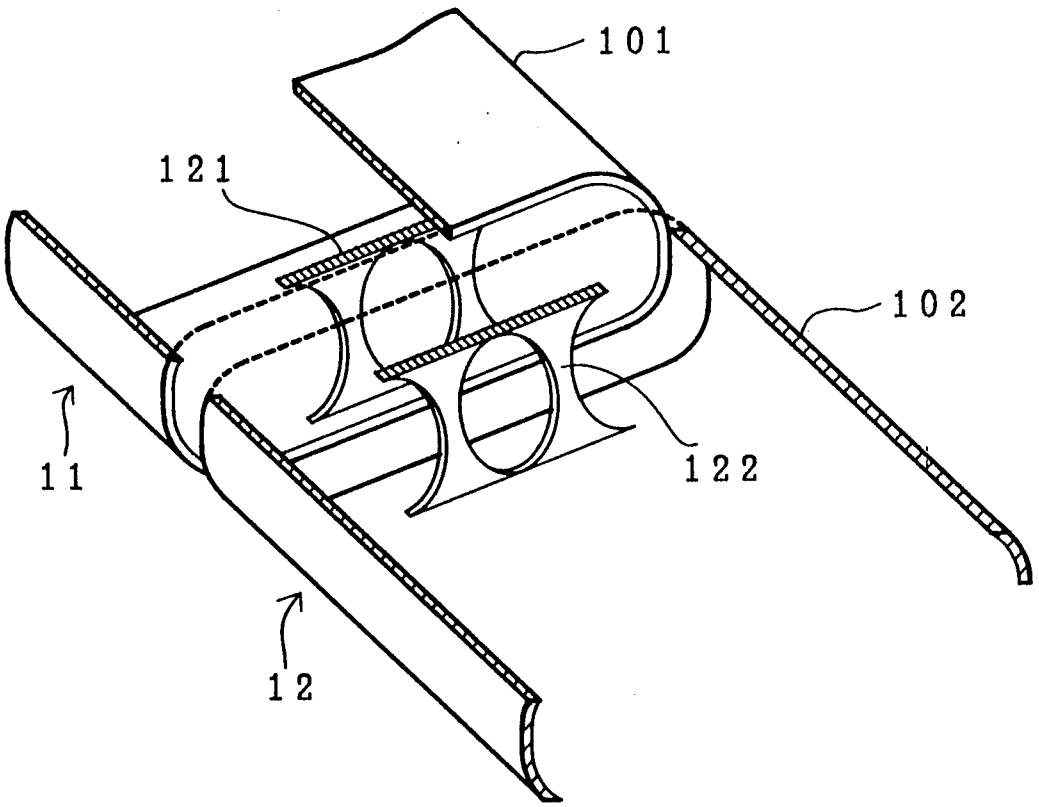
FIG. 2 (PRIOR ART)
FIG. 2 is a diagram for explaining the main lens of electron gun of the prior art.
Figure 4:
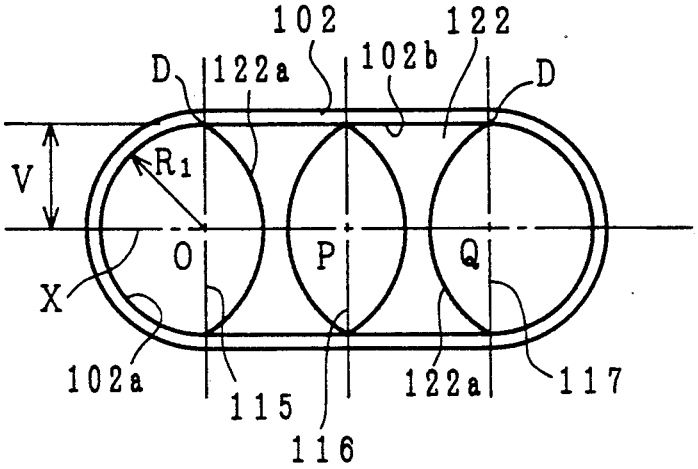
FIG. 4 (PRIOR ART)
FIG. 4 is a sectional view along the line A—A of FIG. 3.
Figure 5:
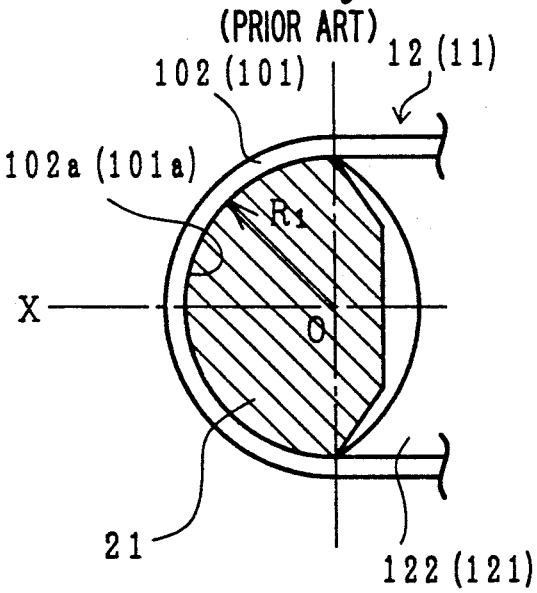
FIG. 5 (PRIOR ART)
FIG. 5 is a sectional view of the essential portion of FIG. 4.
Figure 6:
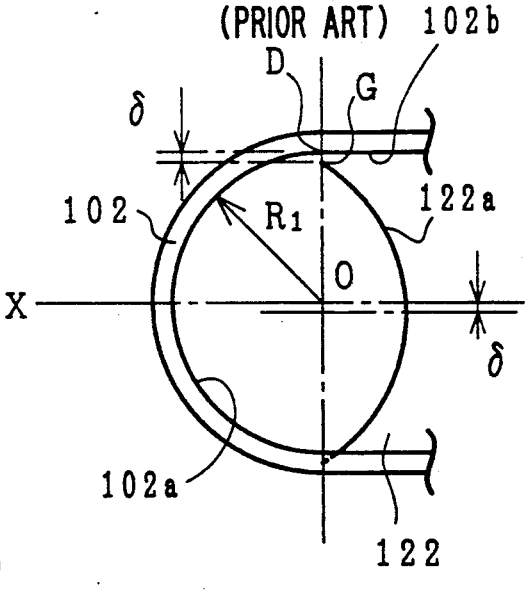
FIG. 6 (PRIOR ART)
FIG. 6 is a sectional view of the essential portion under the condition that the plate electrode is deviated.
Figure 7A:
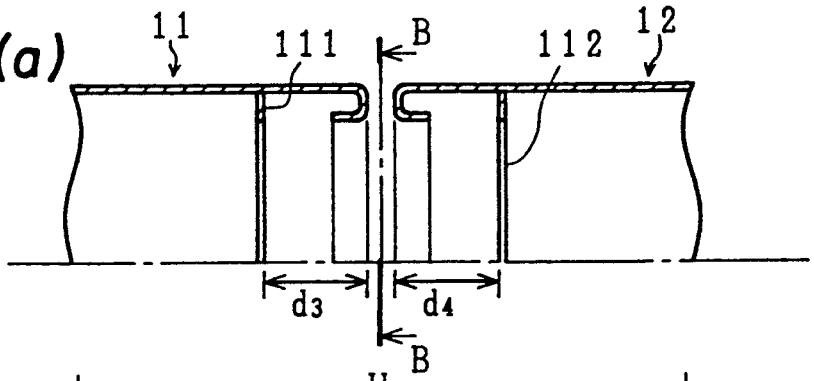
FIG. 7(*a*) to 7(*d*) show diagrams for explaining the main lens electrode indicating an embodiment of an electron gun for color cathode ray tube of the present invention.
Figure 7B:
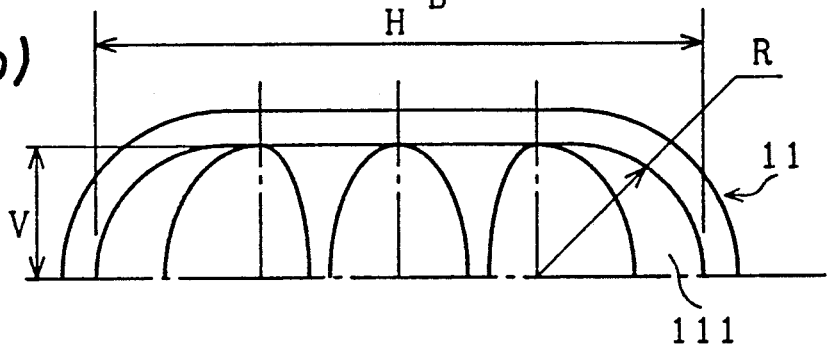
Figure 7C:
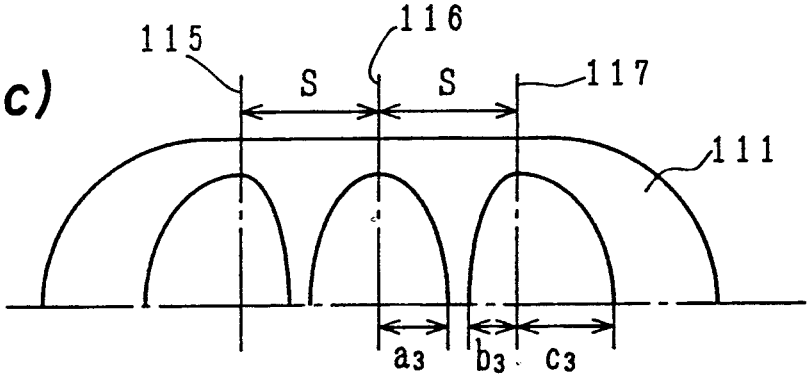
Figure 7D:
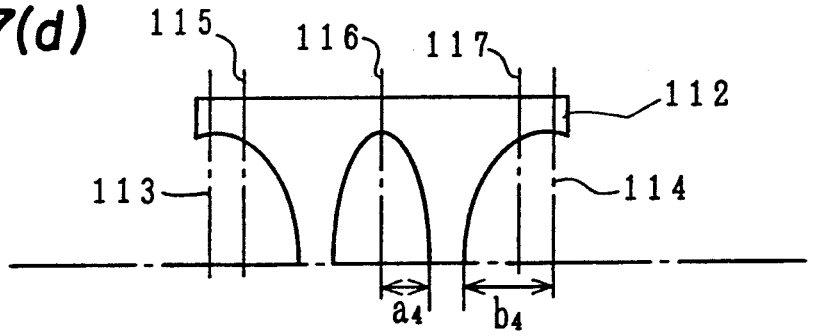

In FIG. 7(*a*) to 7(*d*), both ends of aperture at the opposed surface of focusing electrode 11 and acceleration electrode 12 have the semi-circular shapes like the prior art shown in FIG. 2. Meanwhile, unlike the prior art of FIG. 2, the side portion of the plate electrode 111 of focusing electrode 11 is not given the cutout structure and the vertical axes 113, 114 including the center of side elliptical aperture of the plate electrode 112 of acceleration electrode 12 are externally deviated from the vertical axes 115, 117 crossing the center axes 15, 17 when the side electron beam enters the main lens.

An example of ratings of the structure shown in FIG. 7 is as follows.

d3: 5.2 mm; a3: 2.35 mm; b3: 2.5 mm; c3: 4.0 mm; d4: 4.8 mm; a4: 2.55 mm; b4: 2.85 mm; R: 5.4 mm; V: 5.2 mm; H: 21.8 mm; S: 5.5 mm.

Figure 8:
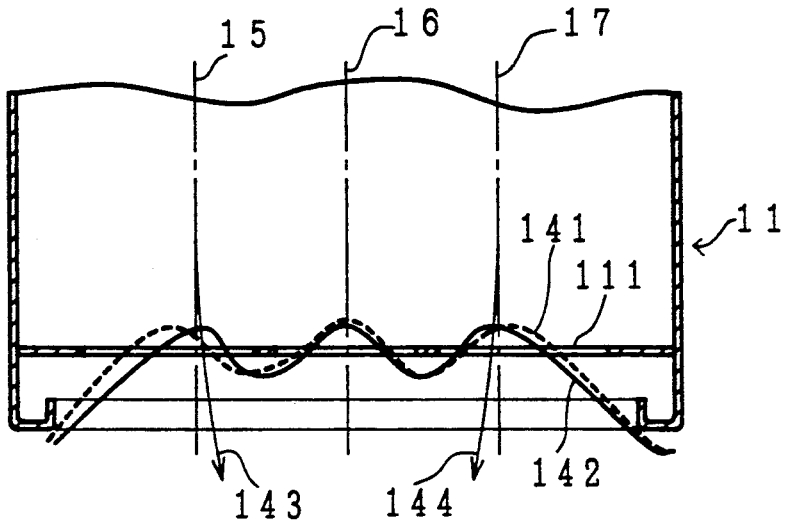
FIG. 8 is a diagram for explaining the effect of the structure of the present invention by the equal voltage line and electron beam orbit at the section in the horizontal direction of the focusing electrode of main lens

FIG. 8 is a diagram for explaining the effect of the structure of the present invention using the equal voltage line and electron beam orbit at the horizontal section of the focusing electrode of the main lens.

In the same figure, the reference numeral 141 denotes the equal voltage line (broken line) in the focusing electrode 11 in case the plate electrode 121 shown in FIG. 2 is used; 142, the equal voltage line (solid line) in case the plate electrode 111 of the present invention is used. The elements like those in FIG. 7 are designated by the like reference numerals.

As shown in the same figure, use of the plate electrode 111 of the present invention displaces the peak of equal voltage line 142 toward the center beam and shifts the center axis of focusing lens. Thereby, the side electron beam orbit is deflected toward the center beam as indicated by the arrow marks 143, 144 and STC can be attained. However, a structure of the plate electrode of the acceleration electrode, which is different from the cutout structure of the plate electrode 111 of the focusing electrode side, is undesirable because the center axis of the divergence lens displaces toward the center beam and the electron beams pass through the external side of center axis of the divergence lens and is deflected to the outside and thereby STC cannot be attained.

Figure 9:
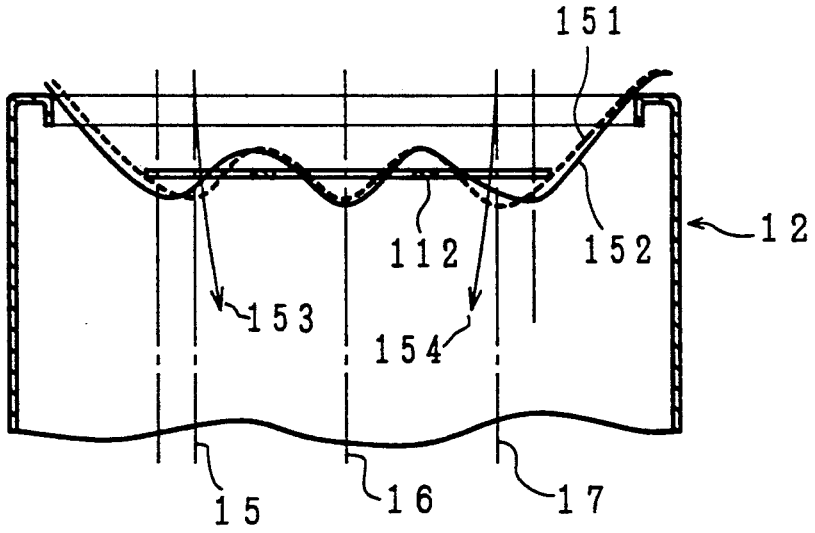
FIG. 9 is a diagram for explaining the effect of a structure of the present invention by the equal voltage line and electron beam orbit at the section in the horizontal direction of the acceleration electrode of main lens.

FIG. 9 is a diagram for explaining the effect of the structure of the present invention by the equal voltage line and electron beam orbit at the horizontal section of the acceleration electrode of main lens.

In the same figure, the reference numeral 151 denotes the equal voltage line (broken line) within the acceleration electrode 12 when the plate electrode 122 shown in FIG. 2 is used; 152, the equal voltage line (solid line) when the plate electrode 112 of the present invention is used. The elements like those in FIG. 7(*a*) are denoted by the like reference numerals.

As shown in the same figure, use of the plate electrode 112 of the present invention causes the center axis of the divergence lens for the side beam to shift to the outside and the electron beam orbit to deflect toward the center beam as shown by the arrow marks 153, 154 to attain the STC.

Figure 10A:
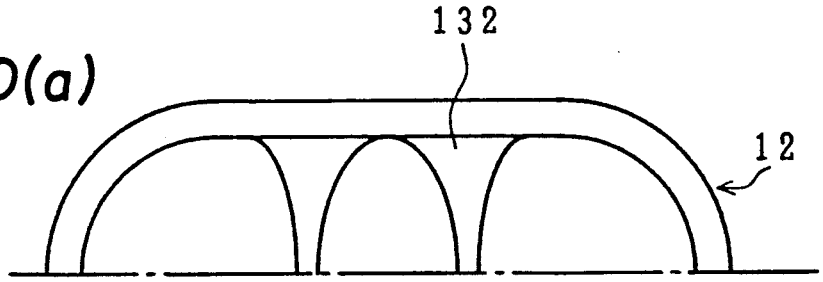
FIG. 10(*a*) and 10(*b*) show diagrams for explaining another embodiment of the present invention.
Figure 10B:
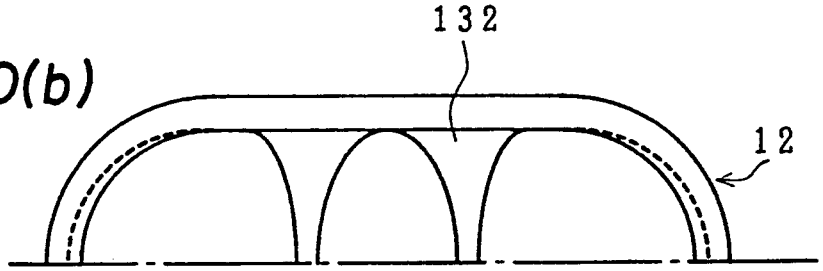

FIG. 10(*a*) and 10(*b*) are diagrams for explaining another embodiment of the present invention. The reference numeral 12 denotes the acceleration electrode; 132, the plate electrode thereof.

In the embodiment explained with reference to FIG. 7(*a*) to 7(*d*), both end portions of the plate electrode through which the side electron beam passes is given the cutout structure and therefore results in a problem that it has smaller mechanical strength and is easily deformed during assembling of the electrodes. The embodiment shown in FIG. 10(*a*) and 10(*b*) does not employ the cutout structure for both end portions of the plate electrode 132, but the structure that both end portions of plate electrode 132 matches with the aperture of the acceleration electrode 12 like FIG. 10(*a*), in view of eliminating the disadvantage in the embodiment of FIG. 7.

FIG. 10(*b*) shows the structure that both end portion of plate electrode 132 are set at the external side of the aperture of the acceleration electrode 12 in order to eliminate the problems in the embodiment of FIG. 7(*a*) to 7(*d*).

Thereby, since both end portions of the plate electrode 132 are provided to the internal wall of the acceleration electrode 12 where the electric field becomes small, distribution of the electric field explained with reference to FIG. 9 does not change and the orbit of side electron beam is deflected toward the center electron beam, attaining STC.

Figure 11:
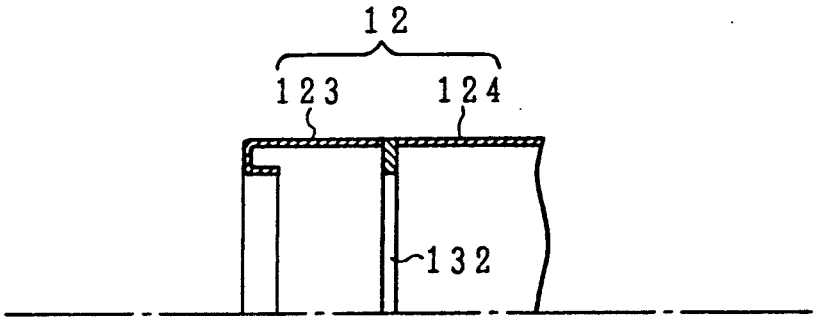
FIG. 11 is a partial sectional view for explaining an example of the assembling structure of the acceleration electrode of an embodiment shown in FIG. 10.

FIG. 11 is a partial sectional view for explaining an example of the assembling structure of the acceleration electrode of the embodiment shown in FIG. 10(*a*) and 10(*b*). The acceleration electrode 12 is divided into a first member 123 and a second member 124, and the plate electrode 132 is disposed between the first member 123 and second member 124. Thereby, this structure provides an advantage that the plate electrode can be set more accurately than insertion of the plate electrode into the acceleration electrode as is done in the embodiment described above.

Use of the plate electrode shown in each embodiment realizes high accuracy assembling of the main lens electrode of an electron gun in which the end portion of aperture at the opposed area of focusing electrode 11 and acceleration electrode 12 is formed as the semi-circular shape setting the center on the center axes 15, 17 when the side electron beam enters the focusing electrode 11 or as the shape cutting out a part of the semi-circular region and also satisfies STC.

Figure 12:
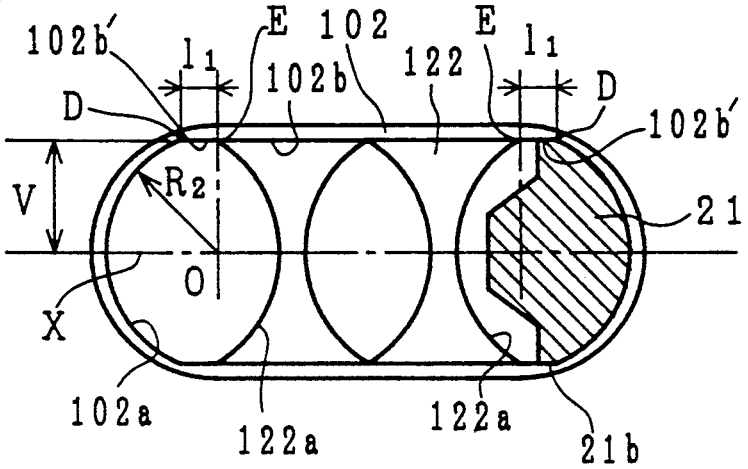
FIG. 12 is a sectional view indicating another embodiment of the acceleration electrode assembling structure of the present invention.

FIG. 12 is a sectional view indicating another embodiment of the acceleration electrode assembling structure by the present invention. In this figure, the plate electrode 122 is formed like the prior art and the arcuated portion 102*a* in the short side of cylindrical electrode 102 can be formed with the radius $R_2$ which is larger than V. Thereby the cross point D of the straight line portion 102*b* and the arcuated portion 102*a* of the cylindrical electrode 102 is separated from the cross point E of the end portion 122*a* of the plate electrode 122 and the straight line portion 102*b* of the cylindrical electrode 102 by the distance $l_1$ and the straight line portion 102*b*' is formed to the apertures for both side beams.

Therefore, since the straight line portion 21*b* of the core bar jig 21 receives the straight line portion 102*b*' of the G4 electrode 12 during assembly of electrodes by forming the straight line portion 21*b* which receives a part of the straight line portion 102*b*' to the core bar jig 21, the G4 electrode 12 does not generate the rotating element for the jig 21. Moreover, since the core bar jig 21 may be manufactured avoiding the cross point E, the G4 electrode 12 does not contact with the plate electrode 122 during insertion and deformation can be prevented.

Figure 13:
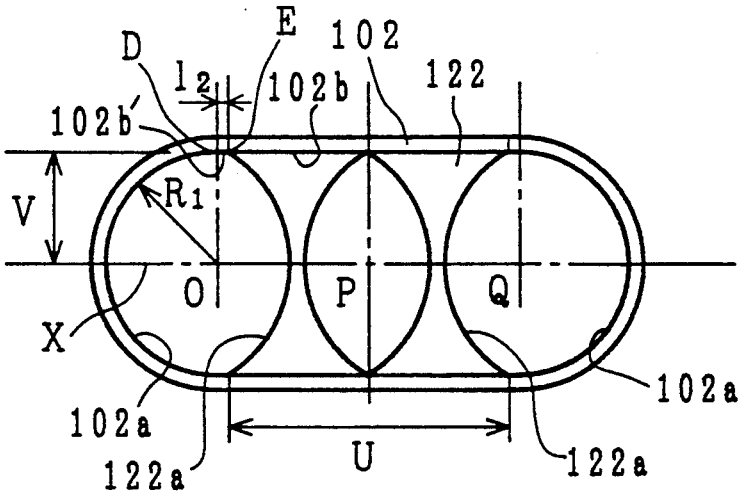
FIG. 13 is a sectional view indicating other embodiment of acceleration electrode assembling structure of the present invention.

FIG. 13 shows another embodiment of the acceleration electrode assembling structure of the present invention. On the contrary to the preceding embodiments, the cylindrical electrode 102 is formed like the prior art in this embodiment and the plate electrode 122 is formed so that the cross point E is provided inside the cross point D in the horizontal direction (longer axis) by the distance $l_2$. Namely, the size U of the plate electrode 122 in the horizontal direction is shorter than the prior art by about the distance $2l_2$. Thereby, the straight line portion 102*b'* is formed to the apertures for both side beams.

The effect as same as that of the preceding embodiment can be obtained by forming the straight line portion 21*b* to the core bar jig 21 to receive the straight line portion 102*b'* as in the case of the embodiment explained above.

In the case of this embodiment, if the distance $l_2$ is set too large, the main lens is distorted thereby and the focus characteristic is deteriorated. As a result of operation check, when $R_1=4$ mm, any side effect cannot be observed for the distance $l_2$ ranging from 0.5 to 1.0 mm.

For the embodiments of the present invention, the bipotential type electron gun has been explained but the present invention is not limited thereto. Namely, the present invention can naturally applied to the union potential type electron gun, multistep focusing type electron gun and other types of electron guns.

As explained previously, the present invention provides an electron gun for color cathode ray tube having excellent functions which realizes easy assembling of electron gun with high accuracy and simultaneously satisfies correction of astigmatism and static convergence.

Moreover, since rotation and deformation of electrodes during assembling electrode can be prevented, aberration of lens generated on the main lens can be reduced and focus characteristic can also be stabilized.

What is claimed is:

1. An electron gun for color cathode ray tube comprising three means arranged almost in parallel toward the phosphor surface to generate three electron beams and a main lens for focusing the three electron beams to the phosphor surface, wherein said main lens is formed by a focusing electrode to which at least a pair of low voltages are applied and an acceleration electrode to which a high voltage is applied, the opposed end surfaces of said focusing electrode and said acceleration electrode are provided with a hollow aperture which allows the three electron beams to pass, a plate electrode forming three apertures for surrounding the three electron beams is provided within said focusing electrode, and a plate electrode forming only one aperture which surrounds the path of the center electron beam among said three electron beams is provided within said acceleration electrode.

2. An electron gun for color cathode ray tube according to claim 1, wherein both end portions of two side apertures among said three apertures allowing side electron beams among said three beams to pass are formed in such a shape as forming at least a part of semi-circular shape in which the center is located at the path of said side electron beams.

3. An electron gun for color cathode ray tube comprising three means arranged almost in parallel toward the phosphor surface to generate three electron beams and a main lens for focusing the three electron beams to the phosphor surface, wherein said main lens is formed by a focusing electrode to which at least a pair of low voltages are applied and an acceleration electrode to which a high voltage is applied, the opposed end surfaces of said focusing electrode and said acceleration electrode are provided with a hollow aperture which allows the three electron beams to pass, each hollow aperture being of the same size, a plate electrode having at least an aperture surrounding the center electron beam among said three beams is provided within said focusing electrode, a plate electrode having at least an aperture surrounding the path of the center electron beam among said three electron beams is provided within said acceleration electrode, and the vertical axes of side apertures of said plate electrode of said acceleration electrode are located outside the path of said electron beams among said three electron beams.

4. An electron gun for color cathode ray tube according to claim 3, wherein both end portions of two side apertures among said three apertures are formed in such a shape forming at least a part of semicircular shape where the center are located at the path of side electron beam among said three electron beams.

5. An electron gun for color cathode ray tube comprising an electrode to form a main lens which is formed by providing an elliptically shaped cylindrical electrode with the arrangement line of three electron beams includes as the longer axis and a plate electrode which is fixed within said cylindrical electrode and forms an aperture only for the center beam to pass and surrounding side beam apertures at both sides with the end portions of said plate electrode and said cylindrical electrode, wherein the end portions of said plate electrode are caused to intersect along a straight line portion of said cylindrical electrode, an intersection is formed inside of the straight line portion of said cylindrical electrode and a semi-circular portion thereof, and the straight line portion is also provided to said side electron beam apertures.

* * * * *